United States Patent [19]

Hantover

[11] Patent Number: 4,909,553

[45] Date of Patent: Mar. 20, 1990

[54] DOG FECES DISPOSAL IMPLEMENT KIT

[76] Inventor: Bruce Hantover, 9613 Aurora Ave. N., Seattle, Wash. 98103

[21] Appl. No.: 313,928

[22] Filed: Feb. 22, 1989

[51] Int. Cl.[4] ..... A01K 29/00; A47L 13/52

[52] U.S. Cl. ..... 294/1.3; 15/257.1; 206/223; 294/55

[58] Field of Search ..... 294/1.3–1.5, 294/25, 55; 15/104.8, 257.1, 257.2, 257.6, 257.7; 119/1; 206/223, 496, 527; 229/52 B

[56] References Cited

U.S. PATENT DOCUMENTS

| | | | |
|---|---|---|---|
| D. 257,406 | 10/1980 | Ouellette | 294/1.3 X |
| 3,286,826 | 11/1966 | Stoll | 294/1.3 |
| 3,767,247 | 10/1973 | Wetzler | 294/1.3 |
| 3,848,906 | 11/1974 | Fleishman | 294/1.3 |
| 3,857,597 | 12/1974 | Young | 294/1.3 |
| 3,978,540 | 9/1976 | Peck et al. | 294/1.3 |
| 4,103,952 | 8/1978 | Thompson | 294/1.3 |
| 4,155,581 | 5/1979 | Kanaga | 294/1.3 |
| 4,186,955 | 2/1980 | Campbell | 294/1.3 |
| 4,205,869 | 6/1980 | Mathis | 294/1.3 |
| 4,251,097 | 2/1981 | Whitten | 294/1.3 |
| 4,272,116 | 6/1981 | Tufte, Jr. | 294/1.3 |
| 4,809,390 | 3/1989 | Jackson et al. | 294/1.3 X |

*Primary Examiner*—Johnny D. Cherry

*Attorney, Agent, or Firm*—Robert W. Beach; Ward Brown

[57] ABSTRACT

A scoop component includes two leaves extending opposite from each other and having adjacent ends joined by a folding and tear line, which folding and tear line is interrupted by an apertured cutout tab projecting from one of the leaves, which leaves have folding lines flaring from the folding and tear line adjacent to the tab toward the corners of the ends of the leaves opposite the folding and tear line, a bag receivable in folded condition between the leaves when they are folded into overlying registration about the folding and tear line, and an envelope for receiving the folded scoop component with the bag received between its leaves and having a slot through which the tab projects for hanging the kit.

3 Claims, 1 Drawing Sheet

Fig. 1
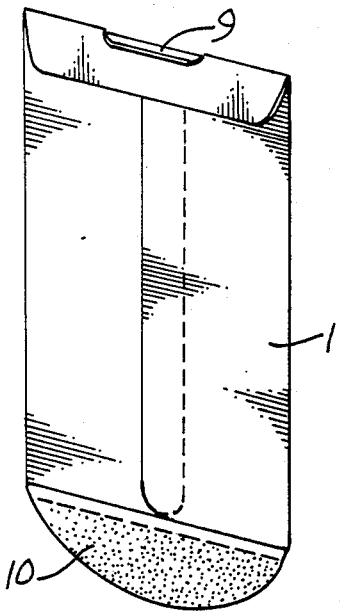
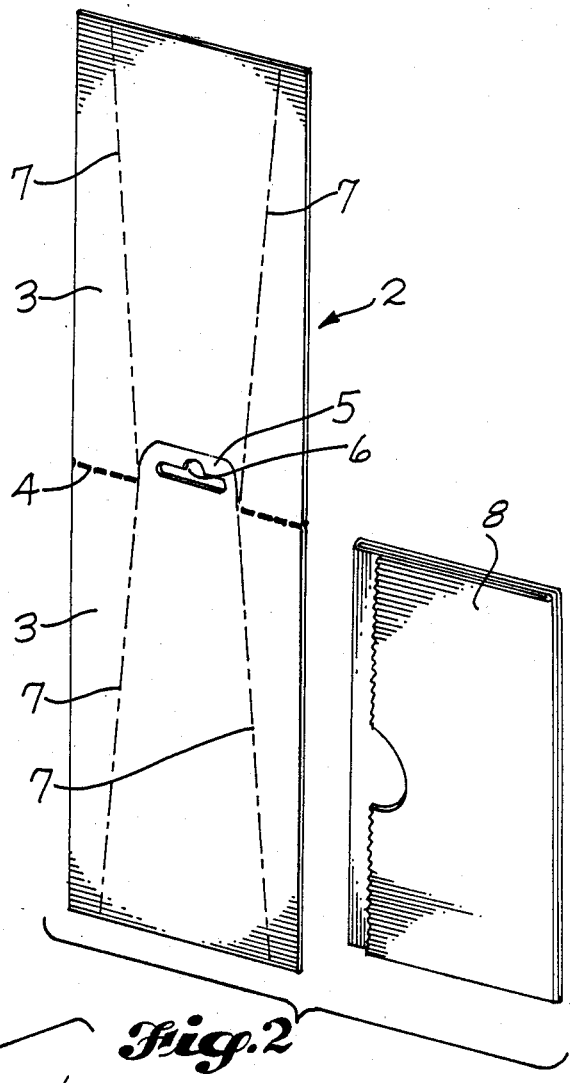
Fig. 2
Fig. 3
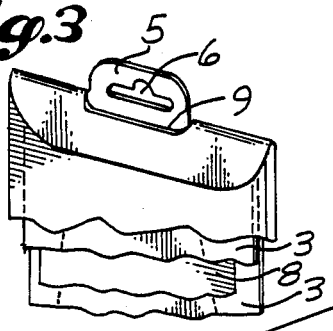
Fig. 4
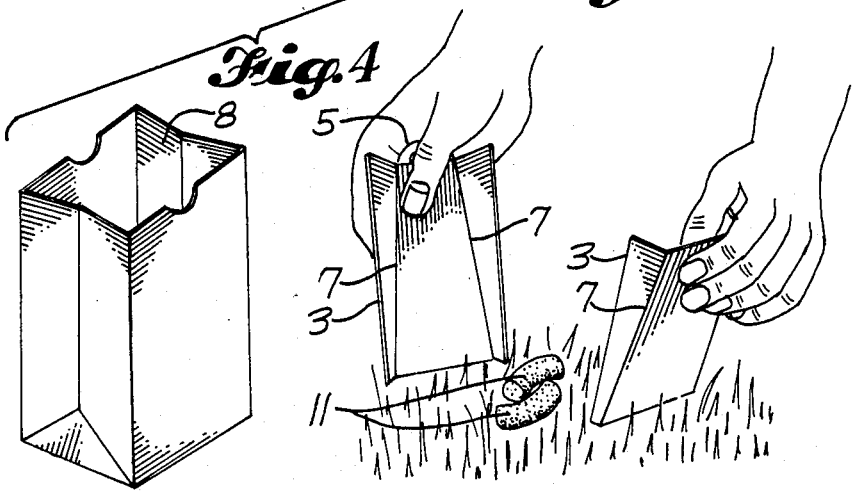

DOG FECES DISPOSAL IMPLEMENT KIT

BACKGROUND OF THE INVENTION

1. Field of the Invention

The present invention relates to a kit of implements for disposing of dog feces by picking up such feces, depositing the feces and temporarily storing the feces.

2. Problem

The problem solved by the present invention is the disposal of excrement dropped by a dog, particularly while being walked on a leash. In many cities it is unlawful for a dog to be outside of the owner's premises without being on a leash. Consequently, it is customary for dogs to be walked while being tethered on a leash. During such walking the dog may defecate. In many cities it is also unlawful for a person walking a dog to fail to remove excrement which may be deposited by a dog while it is being walked. Such removal may be difficult to accomplish in a sanitary manner and without embarrassment.

3. Prior Art

A number of proposals have been made to solve this problem. Apparatus which is comparatively complicated and expensive is disclosed in the following U.S. patents:

Wetzler Pat. No. 3,767,247, issued Oct. 23, 1973

Peck et al. Pat. No. 3,978,540, issued Sept. 7, 1976

Thompson Pat. No. 4,103,952, issued Aug. 1, 1978.

For the most part, the devices of these patents are considered to be impractical.

The form of device shown in FIG. 13 of U.S. Pat. No. 3,767,247 mentioned above is more practical, as are the devices disclosed in the following U.S. patents:

Stoll Pat. No. 3,286,826, issued Nov. 22, 1966

Mathis Pat. No. 4,205,869, issued June 3, 1980

Tufte, Jr. Pat. No. 4,272,116, issued June 9, 1981

These devices, however, are generally more bulky to carry, more difficult to convert to usable condition and more difficult to use than the kit of the present invention.

SUMMARY OF THE INVENTION

A principal object of the present invention is to be able to remove and dispose of dog feces quickly and easily and with a minimum of embarrassment.

An object of the invention is to provide in such kit implements which are compact when being carried, but which can be prepared for use quickly and easily and after use may be discarded.

Another object is to provide such implements of a feces disposal kit which are handy and easy and quick to use for picking up and disposing of dog feces.

It is also an object to provide such components for a feces disposal kit that are made of inexpensive material and which implements can be fabricated economically into the respective kit components.

The foregoing objects can be accomplished by providing a feces disposal implement kit which can be carried easily and unobtrusively by a dog walker. Such kit includes scoops for picking up dog feces, a disposable receptacle for storing the feces temporarily while being transported to a disposal site and a container for the kit components.

BRIEF DESCRIPTION OF THE DRAWINGS

FIG. 1 is a top perspective of a container for a dog feces disposal kit of the present invention, and FIG. 2 is a top perspective of components of the kit, one being shown unfolded.

FIG. 3 is a fragmentary top perspective of a portion of the kit shown in packed condition, and FIG. 4 is a top perspective of components of the kit in use.

DETAILED DESCRIPTION

The dog feces disposal kit is composed of a pack of three components. The first component is an envelope 1 for receiving the other two components. The second component is the double scoop component 2 which is composed of two leaves 3 connected in end-to-end relationship by a combined folding and tear line 4. The central portion of this tear line is interrupted by a cutout tab 5 having an aperture 6.

When the leaves 3 are folded about the folding line 4 into back-to-back registration, the tab will project beyond the folding line as shown in FIG. 4.

At least one and preferably both of the double scoop component leaves 3 has folding lines 7 flaring from the central folding and tear line 4 at opposite sides of the tab 5 toward the opposite corners of the panel ends. Prior to being prepared for use, however, the portions of the leaves at opposite sides of such folding lines would be coplannar.

The third component of the kit is a paper receptacle sack 8 preferably of biodegradable paper material. Such sack is conventional and will be folded to a size somewhat less than the size of a leaf 3 of the double scoop component.

The envelope 1 in which the scoop component 2 and sack 8 are to be received has a central slot 9 in one end of a width and length to enable the tab 5 to pass edgewise through it. The opposite end of the envelope can be closed by a gummed flap 10 bearing adhesive which can be either of the pressure-sensitive type or can be adhesive that is activated by being moistened.

In preparing the kit for merchandizing, the two leaves 3 of the double scoop component 2 are folded toward each other about the folding and tear line 4 into back-to-back registration with the tab 5 projecting beyond the folding and tear line 4. The folded bag 8 is then placed between the folded leaves and the pack formed by the scoop and bag components is inserted tab first past the flap 10 of the envelope 1 into is interior. The pack is then pushed into the envelope until the tab 5 projects through the slot 9 in the opposite end of the envelope as shown in FIG. 3. The flap 10 can then be folded over the open end of the envelope to close it and bonded to the envelope body. The aperture 6 in the projecting tab 5 can be placed over a rod or hook to hang the package for display purposes.

The kit contained in the envelope may be from two to three inches wide and from four to six inches long so that it can be carried conveniently in a pocket or purse.

When it is desired to prepare the kit components for use, the end of the envelope 1 opposite the slot 9 can be cut open, torn open or the flap 10 can be pulled open to provide access to the contents of the envelope for removal.

The leaves 3 of the double scoop component can be opened out and the folding and tear line 4 can be severed to provide two scoop elements. The edge portions of each scoop element can be folded about the folding lines 7 through an angle of 45 to 90 degrees relative to the central panel of the leaf to the shape indicated in FIG. 4. The bag 8 can be unfolded and set on the ground adjacent to feces to be scavenged as shown in FIG. 4. The scoop leaves 3 can then be held one in each hand and one scoop element can be used to load the feces onto the other scoop element, or one leaf can be used to block feces while they are scooped up by the other scoop element. The feces thus held in one scoop element, or clamped between the two scoop elements, can be deposited in the bag 8. The scoop elements also can be placed in the bag and the bag closed for temporarily storing the feces until the bag is deposited in a suitable refuse container.

An advantage to the kit is that all of the components are disposable and preferably composed of biodegradable material so that the kit elements are used only once in the manner described above and then discarded.

I claim:

1. A dog feces disposal implement kit comprising a scoop component including two leaves extending opposite from each other and having adjacent ends joined by a folding and tear line, said folding and tear line being interrupted by an apertured cutout tab projecting from one of said leaves and at least one of said leaves having folding lines flaring from said folding and tear line from locations adjacent to said tab toward the corners of the end of such leaf opposite said folding and tear line, a bag receivable in folded condition between said leaves when folded about said folding and tear line into overlying registration, and an envelope having an open end for reception of said folded scoop component with said bag between said leaves thereof and having a slot in its end opposite said open end for projection of said tab therethrough.

2. The dog feces disposal implement kit defined in claim 1, in which both of the leaves have folding lines flaring from the folding and tear line adjacent to the tab toward the corners of the ends of the leaves opposite the folding and tear line.

3. In a dog feces disposal implement kit, a scoop component including two leaves extending opposite from each other and having adjacent ends joined by a folding and tear line, said folding and tear line being interrupted by an apertured cutout tab projecting from and coplanar with one of said leaves, and at least one of said leaves having folding lines flaring from such folding and tear line toward the corners of the end of such leaf opposite said folding and tear line.

* * * * *